US009677386B2

(12) United States Patent
Nguyen et al.

(10) Patent No.: US 9,677,386 B2
(45) Date of Patent: Jun. 13, 2017

(54) METHODS OF STABILIZING WEAKLY CONSOLIDATED SUBTERRANEAN FORMATION INTERVALS

(71) Applicant: Halliburton Energy Services, Inc., Houston, TX (US)

(72) Inventors: Philip D. Nguyen, Houston, TX (US); Loan K. Vo, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 284 days.

(21) Appl. No.: 13/780,406

(22) Filed: Feb. 28, 2013

(65) Prior Publication Data

US 2014/0238673 A1 Aug. 28, 2014

(51) Int. Cl.
*E21B 43/02* (2006.01)
*E21B 43/26* (2006.01)

(52) U.S. Cl.
CPC ..... *E21B 43/025* (2013.01); *E21B 43/261* (2013.01)

(58) Field of Classification Search
CPC ..... E21B 43/025; E21B 43/04; C09K 8/68
See application file for complete search history.

(56) References Cited

U.S. PATENT DOCUMENTS 4,078,609 A * 3/1978 Pavlich ..... E21B 33/138 166/271
4,143,715 A * 3/1979 Pavlich ..... E21B 33/138 166/271
4,982,793 A 1/1991 Holtmyer et al.
5,067,565 A 11/1991 Holtmyer et al.
5,122,549 A 6/1992 Holtmyer et al.
5,964,291 A * 10/1999 Bourne ..... C09K 8/80 166/279
6,311,773 B1 11/2001 Todd et al.
6,513,592 B2 * 2/2003 Espin ..... B82Y 30/00 166/294
6,632,778 B1 10/2003 Ayoub et al.
6,981,560 B2 1/2006 Nguyen et al.
7,013,973 B2 * 3/2006 Danican ..... C09K 8/5045 166/263
7,032,664 B2 * 4/2006 Lord ..... C09K 8/80 166/276
7,036,592 B2 * 5/2006 Nguyen ..... B82Y 30/00 166/278
7,114,570 B2 10/2006 Nguyen et al.
7,299,875 B2 11/2007 Nguyen et al.
7,306,037 B2 12/2007 Nguyen et al.
7,703,531 B2 * 4/2010 Huang ..... C09K 8/68 166/278
7,721,803 B2 * 5/2010 Huang ..... C09K 8/516 166/276
7,726,399 B2 * 6/2010 Brannon ..... C09K 8/665 166/280.2
7,766,099 B2 8/2010 Nguyen
7,803,347 B2 9/2010 Ajiri
7,926,591 B2 4/2011 Nguyen et al.
8,066,068 B2 * 11/2011 Lesko ..... C09K 8/665 166/280.2
8,082,994 B2 * 12/2011 Nguyen ..... E21B 43/267 166/276
8,105,492 B2 * 1/2012 Huang ..... B82Y 30/00 210/670
8,216,961 B2 * 7/2012 Lee ..... B01J 21/063 502/240
8,307,897 B2 11/2012 Reyes et al.
8,720,571 B2 * 5/2014 Dusterhoft ..... C09K 8/50 166/285
8,783,352 B2 * 7/2014 Chenevert ..... C09K 8/032 166/293
8,822,386 B2 * 9/2014 Quintero ..... C09K 8/032 507/117
8,936,087 B2 * 1/2015 Nguyen ..... C09K 8/56 166/292
9,133,709 B2 * 9/2015 Huh ..... E21B 47/1015
2002/0117302 A1 * 8/2002 Espin ..... B82Y 30/00 166/292
2003/0059742 A1 3/2003 Webster et al.
2005/0016726 A1 * 1/2005 Nguyen ..... B82Y 30/00 166/278
2005/0098315 A1 5/2005 Danican et al.
2005/0272611 A1 * 12/2005 Lord ..... C09K 8/80 507/200
2006/0065398 A1 * 3/2006 Brannon ..... C09K 8/665 166/280.2
2008/0269083 A1 * 10/2008 Argillier ..... C09K 8/536 507/219
2009/0020042 A1 1/2009 Glende et al.
2009/0065209 A1 * 3/2009 Huang ..... C09K 8/68 166/281
2009/0098033 A1 * 4/2009 Lian ..... B01J 13/02 423/213.5

(Continued)

FOREIGN PATENT DOCUMENTS

EP 1126131 A1 8/2001
WO 2014133894 A1 9/2014

OTHER PUBLICATIONS

International Search Report and Written Opinion for PCT/US2014/017684 dated Jun. 24, 2014.
EP Search Report completed on Oct. 25, 2016 in EP 14757487.

*Primary Examiner* — Zakiya W Bates
*Assistant Examiner* — Crystal J Miller
(74) *Attorney, Agent, or Firm* — McDermott Will & Emery LLP

(57) ABSTRACT

Methods of fracturing a weakly consolidated target interval in a wellbore in a subterranean formation including providing a pad fluid comprising an aqueous base fluid and nanoparticulates; providing a fracturing fluid comprising an aqueous base fluid and gravel; introducing the pad fluid in the wellbore at or above a fracture gradient rate so as to create or enhance at least one fracture at or near the weakly consolidated target interval, such that the nanoparticulates in the pad fluid penetrate into the weakly consolidated target interval and into the at least one fracture; introducing the fracturing fluid in the wellbore at or above the fracture gradient rate so as to enhance the at least one fracture and form a proppant pack in the at least one fracture; and consolidating the weakly consolidated target interval.

17 Claims, No Drawings

(56) References Cited

U.S. PATENT DOCUMENTS

2009/0107673 A1* 4/2009 Huang ..... C09K 8/516 166/280.2
2009/0266765 A1* 10/2009 Huang ..... B82Y 30/00 210/670
2009/0314549 A1 12/2009 Chenevert et al.
2010/0056366 A1* 3/2010 Lee ..... B01J 21/063 502/300
2010/0212905 A1 8/2010 van Petegem et al.
2010/0263866 A1 10/2010 Huang et al.
2010/0270023 A1 10/2010 Dusterhoft et al.
2011/0000672 A1* 1/2011 Huang ..... C09K 8/032 166/308.1
2011/0174489 A1* 7/2011 Ross ..... E21B 34/06 166/305.1
2012/0015852 A1* 1/2012 Quintero ..... C09K 8/032 507/112
2012/0043082 A1 2/2012 Nguyen et al.
2012/0055676 A1* 3/2012 Wood ..... C09K 8/602 166/308.1
2013/0091941 A1* 4/2013 Huh ..... E21B 47/1015 73/152.08
2013/0109100 A1* 5/2013 Sarkar ..... C09K 8/03 436/27
2013/0109597 A1* 5/2013 Sarkar ..... C09K 8/03 507/143
2013/0199782 A1* 8/2013 Vidma ..... E21B 43/04 166/278
2013/0341020 A1* 12/2013 Nguyen ..... C09K 8/38 166/270.1
2014/0190686 A1* 7/2014 Cannan ..... E21B 43/25 166/250.01
2014/0349894 A1* 11/2014 Quintero ..... C09K 8/032 507/110
2014/0367105 A1* 12/2014 Karcher ..... C09K 8/426 166/295

* cited by examiner

METHODS OF STABILIZING WEAKLY CONSOLIDATED SUBTERRANEAN FORMATION INTERVALS

BACKGROUND

The present invention relates to methods of stabilizing weakly consolidating subterranean formation intervals.

Hydrocarbon-bearing subterranean formations often contain one or more weakly consolidated intervals. As used herein, the term "weakly consolidated interval" (or "weakly consolidated target interval" or "weakly consolidated formation") refers to one or more portions of a subterranean formation that contains loose particles and/or particles having insufficient bond strength to withstand the forces created by the production (or injection) of fluids through the formation during subterranean treatment operations. These particles may include, for example, sand, clay, or other fine particulate solids formed from the subterranean formation. A weakly consolidated interval may also be found in or near fractures in the subterranean formation. Some subterranean formations may initially be weakly consolidated or may become so due to pumping operations or production of fluids upward through the wellbore in the formation.

Weakly consolidated formations may contain substantial quantities of oil and gas, but recovery of the oil and gas is often difficult due to the movement of the loose particles. The movement of the loose particles imposes limitations on the drawdown pressure within the subterranean formation. As used herein, the term "drawdown pressure" refers to the differential pressure that drives fluids from within a wellbore to the surface. Therefore, loose particles limit the rate at which fluids can be produced from the subterranean formation.

One approach designed to prevent the movement of loose particles in a wellbore in a subterranean formation (or to "stabilize" or "consolidate") is the use of gravel packing or frac-packing techniques. As used herein, the term "gravel packing" refers to a particulate control method in which a permeable screen is placed in a wellbore in a subterranean formation and the annulus between the screen and the formation surface is packed with gravel of a specific size designed to prevent the passage of loose particles from weakly consolidated intervals through the gravel packed screen, referred to as a "gravel pack." As used herein, the term "frac-packing" refers to a combined hydraulic fracturing and gravel packing treatment. In such frac-packing operations, a substantially particulate-free fluid is generally pumped through the annulus between the permeable screen and the wellbore in the subterranean formation at a rate and pressure sufficient to create or enhance at least one fracture. Thereafter, a treatment fluid comprising particulates is pumped through the annulus between the permeable screen and the wellbore in the subterranean formation and the particulates are placed within the at least one fracture and in the annulus between the permeable screen and the wellbore in the subterranean formation, forming both a proppant pack and a gravel pack. In some embodiments, the treatment fluid comprising the particulates may be pumped at a rate and pressure sufficient to enhance the at least one fracture already formed.

In both gravel packing and frac-packing operations, loose particles may still escape the confines of the gravel pack and flow into the wellbore opening, limiting drawdown pressure. This may be particularly true if the loose particles have a particularly large size range, such that the gravel pack is not capable of preventing all loose particles from migrating through the pack.

Another technique for controlling the movement of loose particles in weakly consolidated formations involves treating the formation (or proppant particulates) with a consolidating agent to facilitate compaction of the loose particles within the formation and prevent them from migrating from the formation. However, consolidating agents are often difficult to handle, transport, and clean-up. For example, consolidating agents may cause damage to subterranean treatment equipment due to their inherent tendency to form a sticky or tacky surface.

Accordingly, an ongoing need exists for methods of stabilizing weakly consolidated subterranean formation intervals.

SUMMARY OF THE INVENTION

The present invention relates to methods of stabilizing weakly consolidating subterranean formation intervals.

In some embodiments, the present invention provides a method of fracturing a weakly consolidated target interval in a wellbore in a subterranean formation comprising: providing a pad fluid comprising an aqueous base fluid and nanoparticulates; providing a fracturing fluid comprising an aqueous base fluid and gravel; introducing the pad fluid in the wellbore in the subterranean formation at or above a fracture gradient rate so as to create or enhance at least one fracture at or near the weakly consolidated target interval in the wellbore in the subterranean formation, such that the nanoparticulates in the pad fluid penetrate into the weakly consolidated target interval and into the at least one fracture; introducing the fracturing fluid in the wellbore in the subterranean formation at or above the fracture gradient rate so as to enhance the at least one fracture and form a proppant pack in the at least one fracture; and consolidating the weakly consolidated target interval due to the placement of the nanoparticulates penetrated into the weakly consolidated target interval and into the at least one fracture.

In other embodiments, the present invention provides a method of gravel packing a weakly consolidated target interval in a wellbore in a subterranean formation comprising: positioning a permeable screen within the wellbore in the subterranean formation adjacent to the weakly consolidated target interval to form an annulus between the permeable screen and the wellbore in the subterranean formation; providing a pad fluid comprising an aqueous base fluid and nanoparticulates; providing a gravel packing fluid comprising an aqueous base fluid and gravel; introducing the pad fluid in the annulus between the permeable screen and the wellbore in the subterranean formation at a matrix flow rate, such that the nanoparticulates in the pad fluid penetrate into the weakly consolidated target interval; introducing the gravel packing fluid in the annulus between the permeable screen and the wellbore in the subterranean formation at a matrix flow rate so as to form a permeable gravel pack adjacent to the weakly consolidated target interval; and consolidating the weakly consolidated target interval due to the placement of the nanoparticulates penetrated into the weakly consolidated target interval and the permeable gravel pack adjacent to the weakly consolidated target interval.

In still other embodiments, the present invention provides a method of frac-packing a weakly consolidated target interval in a wellbore in a subterranean formation comprising: positioning a permeable screen within the wellbore in the subterranean formation adjacent to the weakly consolidated target interval to form an annulus between the permeable screen and the wellbore in the subterranean formation; providing a pad fluid comprising an aqueous base fluid and nanoparticulates; providing a frac-packing fluid comprising an aqueous base fluid and gravel; introducing the pad fluid in the annulus between the permeable screen and the wellbore in the subterranean formation at or above a fracture gradient rate so as to create or enhance at least one fracture at or near the weakly consolidated target interval in the wellbore in the subterranean formation, such that the nanoparticulates in the pad fluid penetrate into the weakly consolidated target interval and into the at least one fracture; introducing the frac-packing fluid in the annulus between the permeable screen and the wellbore in the subterranean formation at or above the fracture gradient rate so as to enhance the at least one fracture, form a proppant pack in the at least one fracture, and form a permeable gravel pack adjacent to the weakly consolidated target interval and the at least one fracture; and consolidating the weakly consolidated target interval due to the placement of the nanoparticulates penetrated into the weakly consolidated target interval and into the at least one fracture and the permeable gravel pack adjacent to the weakly consolidated target interval and the at least one fracture.

The features and advantages of the present invention will be readily apparent to those skilled in the art upon a reading of the description of the preferred embodiments that follows.

DETAILED DESCRIPTION

The present invention relates to methods of stabilizing weakly consolidating subterranean formation intervals. More particularly, the present invention relates to methods of treating weakly consolidated subterranean formation intervals as part of fracturing, gravel packing, or frac-packing operations using nanoparticulates.

In some embodiments, the present invention provides a method of fracturing a weakly consolidated target interval in a wellbore in a subterranean formation. A pad fluid comprising an aqueous base fluid and nanoparticulates is introduced into the wellbore in the subterranean formation at or above a fracture gradient rate so as to create or enhance at least one fracture at or near the weakly consolidated target interval in the wellbore in the subterranean formation, such that the nanoparticulates in the pad fluid penetrate into the weakly consolidated target interval and into the at least one fracture. As used herein, the term "fracture gradient" or "fracture gradient rate" refers to the flow rate necessary to induce or enhance fractures in a subterranean formation and may depend, for example, on the depth of the wellbore. As used herein, the term "fracture" refers to any man-made opening in a subterranean formation including, but not limited to, a fracture, a crack, a perforation, a slot, and the like. After the pad fluid is introduced, a fracturing fluid comprising an aqueous base fluid and gravel is introduced into the annulus between the permeable screen and the wellbore in the subterranean formation at or above the fracture gradient rate so as to enhance the at least one fracture and form a proppant pack in the at least one fracture. As used herein, the term "matrix flow rate" refers to a flow rate which is sufficiently high to allow fluid to move through the wellbore and penetrate the subterranean formation, but insufficient to create or enhance fractures within the formation. As used herein, the term "fracture" refers to any man-made opening in a subterranean formation including, but not limited to, a fracture, a crack, a perforation, a slot, and the like. As used herein, the term "proppant pack" refers to a collection of a mass of the gravel used in the methods of the present invention within a fracture in a subterranean formation that is capable of propping the fracture in an open condition while allowing fluid flow through the pack. Lastly, the weakly consolidated target interval is consolidated due to the placement of the nanoparticulates penetrated into the weakly consolidated target interval and into the at least one fracture. Typically, the nanoparticulates penetrate the weakly consolidated target interval in the range between from about 1 to about 6 wellbore diameters, and more preferably in the range from about 3 to about 6 wellbore diameters. In other embodiments, prepad fluid comprising an aqueous base fluid and nanoparticulates is introduced into the wellbore in the subterranean formation at a matrix flow rate, such that the nanoparticulates in the prepad fluid penetrate into the weakly consolidated target interval prior to the step of introducing the pad fluid in the wellbore in the subterranean formation. As used herein, the term "matrix flow rate" refers to a flow rate which is sufficiently high to allow fluid to move through the wellbore and penetrate the subterranean formation, but insufficient to create or enhance fractures within the formation.

In some embodiments, the present invention provides a method of gravel packing a weakly consolidated target interval in a wellbore in a subterranean formation. In screened gravel packing operations, a permeable screen is positioned within the wellbore in the subterranean formation adjacent to the weakly consolidated target interval, forming an annulus between the permeable screen and the wellbore in the subterranean formation. In methods of the present invention, a pad fluid comprising an aqueous base fluid and nanoparticulates is then introduced into the annulus between the permeable screen and the wellbore at a matrix flow rate, such that the nanoparticulates in the pad fluid penetrate a distance in the range between from about 1 to about 6 wellbore diameters into the weakly consolidated target interval. In preferred embodiments, the nanoparticulates in the pad fluid penetrate a distance in the range from about 3 to about 6 wellbore diameters. After the pad fluid is introduced, a gravel packing fluid comprising an aqueous base fluid and gravel is introduced into the annulus between the permeable screen and the wellbore in the subterranean formation. As used herein, the term "gravel" refers to not only natural gravel, but other proppant-type materials, natural and man-made, such as, for example, sand; bauxite; ceramic materials; glass materials; polymer materials; polytetrafluoroethylene materials; nut shell pieces; cured resinous particulates comprising nut shell pieces; seed shell pieces; cured resinous particulates comprising seed shell pieces, fruit pit pieces, cured resinous particulates comprising fruit pit pieces; wood; composite particulates; and any combination thereof. Suitable composite particulates may comprise a binder and a filler material wherein suitable filler materials include, but are not limited to, silica; alumina; fumed carbon; carbon black; graphite; mica; titanium dioxide; meta-silicate; calcium silicate; kaolin; talc; zirconia; boron; fly ash; hollow glass microspheres; solid glass; and any combination thereof. The gravel in the gravel packing fluid packs the annulus between the permeable screen and the wellbore in the subterranean formation so as to form a permeable gravel pack. The weakly consolidated target interval is consolidated due to the placement of the nanoparticulates penetrated into the weakly consolidated target interval and the permeable gravel pack adjacent to the weakly consolidated target interval.

In other embodiments, the present invention provides a method of frac-packing a weakly consolidated target interval in a wellbore in a subterranean formation. In screened gravel packing operations, a permeable screen is positioned within the wellbore in the subterranean formation adjacent to the weakly consolidated target interval, forming an annulus between the permeable screen and the wellbore in the subterranean formation. In these methods, a pad fluid comprising an aqueous base fluid and nanoparticulates is introduced in the annulus between the permeable screen and the wellbore in the subterranean formation at or above a fracture gradient rate so as to create or enhance at least one fracture at or near the weakly consolidated target interval in the wellbore in the subterranean formation, such that the nanoparticulates in the pad fluid penetrate into the weakly consolidated target interval and into the at least one fracture. After the pad fluid is introduced, a frac-packing fluid comprising an aqueous base fluid and gravel is introduced into the annulus between the permeable screen and the wellbore in the subterranean formation at or above the fracture gradient rate so as to enhance the at least one fracture, form a proppant pack in the at least one fracture, and form a permeable gravel pack adjacent to the weakly consolidated target interval and the at least one fracture. Lastly, the weakly consolidated target interval is consolidated due to the placement of the nanoparticulates penetrated into the weakly consolidated target interval and the permeable gravel pack adjacent to the weakly consolidated target interval. Typically, the nanoparticulates penetrate the weakly consolidated target interval in the range between from about 1 to about 6 wellbore diameters, and more preferably in the range from about 3 to about 6 wellbore diameters.

The pad fluid of the methods of the present invention comprise nanoparticulates. The nanoparticulates act to consolidate loose particles in a weakly consolidated formation interval or a newly created fracture, for example. The nanoparticulates are capable of consolidating loose particles due to the formation of stable bridge points or bonds between the loss particles of the formation and the nanoparticulates, such that the drag forces of flowing fluids are not able to overcome the loose particles and carry them within the fluids. Moreover, these bridge points or bonds may also interact between individual or groups of nanoparticulates, thereby forming a self-assembled network of nanoparticulates. This may be particularly beneficial when the weakly consolidated interval and/or fracture is particularly large or vugular. Suitable nanoparticulates for use in the present invention may include, but are not limited to, a silk; a cellulose; a starch; a polyamid; carbon silica; alumina; zirconia; a polyurethane; a polyester; a polyolefin; collagen; a polyglycolic; an alkaline earth metal oxide; an alkaline earth metal hydroxide; an alkali metal oxide; an alkali metal hydroxide; a transition metal oxide; a transition metal hydroxide; a post-transition metal oxide; a post-transition metal hydroxide; a piezoelectric crystal; a pyroelectric crystal; and any combination thereof. Suitable alkaline earth metals may be selected from the group consisting of magnesium; calcium; strontium; barium; and any combination thereof. Suitable alkali metals may be selected from the group consisting of lithium; sodium; potassium; and any combination thereof. Suitable transition metals may be selected from the group consisting of titanium; zinc; and any combination thereof. Suitable post-transition metals may be selected from the group consisting of aluminum; piezoelectric crystal; pyroelectric crystal; and combinations thereof.

The nanoparticulates may be of any shape suitable for use in fracturing, gravel packing, or frac-packing operations in accordance with the methods of the present invention. Suitable shapes may include, but are not limited to, sphere-shaped; rod-shaped; fiber-shaped; cup-shaped; cube-shaped; truncated cube-shaped; rhombic dodecahedron-shaped; truncated rhombic-dodecahedron-shaped; oval-shaped; diamond-shaped; pyramid-shaped; polygon-shaped; torus-shaped; dendritic-shaped; astral-shaped; cylinder-shaped; irregular-shaped; triangular-shaped; bipyramid-shaped; tripod-shaped; wire-shaped; tetrahedron-shaped; cuboctahedron-shaped; octahedron-shaped; truncated octahedron-shaped; icosahedron-shaped; and any combination thereof. In some embodiments, the nanoparticulates of the present invention range in mesh size from about 1 to about 200 nanometers ("nm"), U.S. Sieve Series. In preferred embodiments, the nanoparticulates of the present invention range in mesh size from about 1 to about 100 nm, U.S. Sieve Series. In some embodiments, the mean particle mesh size of the nanoparticulates of the present invention is less than about 100 nm, U.S. Sieve Series.

In some embodiments, the preferred shape of the nanoparticulates of the present invention is fiber-shaped. Such fiber-shapes may enhance the ability of the nanoparticulate to burrow into weakly consolidated intervals and/or fractures, as well as provide some flexibility to adapt to different types of weakly consolidated intervals. When the shape of the nanoparticulate is fiber-shaped, for example, the size of the fiber may have a diameter in the range of about 10 to about 100 nm, and a length in the range of about 50 to 800 nm. Preferably, when fiber-shaped nanoparticulates are used in the methods of the present invention, they are produced from materials including, but not limited to, a silk; a cellulose; a starch; a polyamid; carbon silica; alumina; zirconia; a polyurethane; a polyester; a polyolefin; collagen; a polyglycolic; or any combination thereof. However, other nanoparticulate materials may also be utilized, as disclosed herein.

In some embodiments, the nanoparticulates of the present invention may be impregnated with ions. The ions may facilitate the individual nanoparticulates to aggregate together and form a network. Suitable ions that may be used to impregnate the nanoparticulates of the present invention may include, but are not limited to, a monoatomic cation; a monoatomic anion; a polyatomic cation; a polyatomic anion; and any combination thereof. Suitable examples of monoatomic cations include, but are not limited to, hydrogen; lithium; sodium; potassium; rubidium; cesium; silver; magnesium; calcium; strontium; barium; zinc; cadmium; aluminum; bismuth; and any combination thereof. Suitable examples of monoatomic anions include, but are not limited to, hydride; fluoride; chloride; bromide; iodide; oxide; sulfide; nitride; phosphide; carbide; and any combination thereof. Suitable examples of polyatomic cations include, but are not limited to, ammonium; hydronium; and any combination thereof. Suitable examples of polyatomic anions include, but are not limited to, hydroxide; cyanide; peroxide; carbonate; oxalate; nitrite; nitrate; phosphate; phosphite; sulfite; sulfate; thiosulfate; hypochlorite; chlorite; chlorate; perchlorate; acetate; arsenate; borate; silicate; permanganate; chromate; dichromate; formate; bicarbonate; bisulfite; bisulfate; hydrogen phosphate; dihydrogen phosphate; and any combination thereof. In some embodiments, the ions used to impregnate the nanoparticulates of the present invention are included in an amount of about 0.1% to about 20% by weight of the nanoparticulates. In other embodiments, the ions used to impregnate the nanoparticulates of the present invention are included in an amount of about 1% to about 5% by weight of the nanoparticulates. In some embodiments, a chelating agent and/or a coupling agent may be used to facilitate impregnation of the ions on the nanoparticulates of the present invention. It is within the ability of one of ordinary skill in the art, with the benefit of this disclosure, to determine whether and how much of a chelating agent and/or coupling agent is needed to achieve the desired results.

The pad fluids, fracturing fluids, gravel packing fluids, and frac-packing fluids of the present invention each comprise an aqueous base fluid. Aqueous base fluids suitable for use in the fluids of the present invention may comprise fresh water; saltwater (e.g., water containing one or more salts dissolved therein); brine (e.g., saturated salt water); seawater; and any combinations thereof. Generally, the water may be from any source, provided that it does not contain components that might adversely affect the stability and/or performance of the fluids of the present invention. In certain embodiments, the density of the aqueous base fluid can be adjusted, among other purposes, to enhance particle transport and suspension. As used herein, the term "particle" generally refers to a single piece or fragment of a substance or an agglomeration or grouping of pieces of fragments of a substance, and includes, for example, the nanoparticulates, gravel, and additives of the present invention. The aqueous base fluid of the pad fluid may be of the same composition as the aqueous base fluid of the fracturing fluid, gravel packing fluid, or the frac-packing fluid, but need not be. In certain embodiments, the pH of the aqueous base fluid may be adjusted (e.g., by a buffer or other pH adjusting agent), such as, for example, to activate a crosslinking agent and/or to reduce the viscosity of the first treatment fluid (e.g., activate a breaker, deactivate a crosslinking agent). In these embodiments, the pH may be adjusted to a specific level, which may depend on, among other factors, the types of additives included in the treatment fluid. In some embodiments, the pH range may preferably be from about 4 to about 11. One of ordinary skill in the art, with the benefit of this disclosure, will recognize the type of aqueous base fluid to use in the fluids of the present invention and when density and/or pH adjustments are appropriate.

In some embodiments, the aqueous base fluid for use in the pad fluid, fracturing fluid, gravel packing fluid, and/or frac-packing fluid of the present invention may be viscosified using a water-soluble viscosifying compound. Viscosifying the fluids of the present invention may increase the suspension capacity of particles by the fluids. Suitable viscosifying compounds for use in the present invention include, but are not limited to, gelling agents; crosslinked gelling agents; foaming agents; and combinations thereof. In preferred embodiments, at least the fracturing fluid, gravel packing fluid, and the frac-packing fluid of the present invention comprise a water-soluble viscosifying compound. In some embodiments, the pad fluid and the fracturing fluid, gravel packing fluid, or frac-packing fluid of the present invention each comprise a water-soluble viscosifying compound which may be either identical or different. For example, the pad fluid may comprise a gelling agent and the fracturing fluid, gravel packing fluid, or frac-packing fluid may comprise a foaming agent. In other nonlimiting examples, the pad fluid and the fracturing fluid, gravel-packing fluid, or frac-packing fluid may each contain a gelling agent that is different in composition (i.e., different types of gelling agents). In other embodiments, the pad fluid may be devoid of a water-soluble viscosifying agent. This may be particularly so if the nanoparticulates in the pad fluid are sufficiently suspended in the pad fluid without the use of a water-soluble viscosifying agent.

Suitable gelling agents for use as a water-soluble viscosifying agent of the present invention may comprise any substance (e.g., a polymeric material) capable of increasing the viscosity of the fluids of the present invention (e.g., pad fluid, fracturing fluid, gravel packing fluid, and frac-packing fluid). The gelling agents may be naturally-occurring gelling agents, synthetic gelling agents, or a combination thereof. The gelling agents also may be cationic gelling agents, anionic gelling agents, or a combination thereof. Suitable gelling agents include, but are not limited to, polysaccharides; biopolymers; derivatives thereof that contain one or more of these monosaccharide units: galactose, mannose, glucoside, glucose, xylose, arabinose, fructose, glucuronic acid, or pyranosyl sulfate; and any combination thereof. Examples of suitable polysaccharides include, but are not limited to, guar gums (e.g., hydroxyethyl guar, hydroxypropyl guar, carboxymethyl guar, carboxymethylhydroxyethyl guar, and carboxymethylhydroxypropyl guar ("CMHPG")); cellulose derivatives (e.g., hydroxyethyl cellulose, carboxyethylcellulose, carboxymethylcellulose, and carboxymethylhydroxyethylcellulose); xanthan; scleroglucan; succinoglycan; diutan; and any combination thereof.

Suitable synthetic polymers include, but are not limited to, 2,2'-azobis(2,4-dimethyl valeronitrile); 2,2'-azobis(2,4-dimethyl-4-methoxy valeronitrile); polymers and copolymers of acrylamide ethyltrimethyl ammonium chloride; acrylamide; acrylamido-alkyl trialkyl ammonium salt; methacrylamido-alkyl trialkyl ammonium salt; acrylamidomethylpropane sulfonic acid; acrylamidopropyl trimethyl ammonium chloride; acrylic acid; dimethylaminoethyl methacrylamide; dimethylaminoethyl methacrylate; dimethylaminopropyl methacrylamide; dimethyldiallylammonium chloride; dimethylethyl acrylate; fumaramide; methacrylamide; methacrylamidopropyl trimethyl ammonium chloride; methacrylamidopropyldimethyl-n-dodecylammonium chloride; methacrylamidopropyldimethyl-n-octylammonium chloride; methacrylamidopropyltrimethylammonium chloride; methacryloylalkyl trialkyl ammonium salt; methacryloylethyl trimethyl ammonium chloride; methacrylylamidopropyldimethylcetylammonium chloride; N-(3-sulfopropyl)-N-methacrylamidopropyl-N,N-dimethyl ammonium betaine; N,N-dimethylacrylamide; N-methylacrylamide; nonylphenoxypoly(ethyleneoxy)ethylmethacrylate; partially hydrolyzed polyacrylamide; poly 2-amino-2-methyl propane sulfonic acid; polyvinyl alcohol; sodium 2-acrylamido-2-methylpropane sulfonate; quaternized dimethylaminoethylacrylate; quaternized dimethylaminoethylmethacrylate; any derivative thereof; and any combination thereof. In certain embodiments, the gelling agent may comprise an acrylamide/2-(methacryloyloxy)ethyltrimethylammonium methyl sulfate copolymer. In certain embodiments, the gelling agent may comprise an acrylamide/2-(methacryloyloxy)ethyltrimethylammonium chloride copolymer. In certain embodiments, the gelling agent may comprise a derivatized cellulose that comprises cellulose grafted with an allyl or a vinyl monomer, such as those disclosed in U.S. Pat. Nos. 4,982,793, 5,067,565, and 5,122,549, the entire disclosures of which are incorporated herein by reference.

Additionally, polymers and copolymers that comprise one or more functional groups (e.g., hydroxyl, cis-hydroxyl, carboxylic acids, derivatives of carboxylic acids, sulfate, sulfonate, phosphate, phosphonate, amino, or amide groups) may be used as gelling agents.

In those embodiments in which a gelling agent is used as the water-soluble viscosifying compound of the present invention, the gelling agent may be present in the fluids useful in the methods of the present invention in an amount sufficient to provide the desired viscosity. In some embodiments, the gelling agents (i.e., the polymeric material) may be present in an amount in the range of from about 0.1% to about 10% by weight of the fluid. In certain embodiments, the gelling agents may be present in an amount in the range of from about 0.15% to about 2.5% by weight of the fluid.

In some embodiments, a crosslinked gelling agent may be suitable for use in the present invention as a water-soluble viscosifying agent. A crosslinked gelling agent may comprise any gelling agent suitable for use in the present invention, as discussed above, and a crosslinking agent. The crosslinking agent may be capable of crosslinking at least two molecules of a gelling agent. Suitable crosslinking agents include, but are not limited to, borate ions; magnesium ions; zirconium IV ions; titanium IV ions; aluminum ions; antimony ions; chromium ions; iron ions; copper ions; magnesium ions; zinc ions; and any combination thereof. These ions may be provided by providing any compound that is capable of producing one or more of these ions. Examples of such compounds include, but are not limited to, ferric chloride; boric acid; disodium octaborate tetrahydrate; sodium diborate; pentaborates; ulexite; colemanite; magnesium oxide; zirconium lactate; zirconium triethanol amine, zirconium lactate triethanolamine, zirconium carbonate, zirconium acetylacetonate; zirconium malate; zirconium citrate; zirconium diisopropylamine lactate; zirconium glycolate; zirconium triethanol amine glycolate; zirconium lactate glycolate; titanium lactate; titanium malate; titanium citrate; titanium ammonium lactate; titanium triethanolamine; titanium acetylacetonate; aluminum lactate; aluminum citrate; an antimony compound; a chromium compound; an iron compound; a copper compound; a zinc compound; and any combination thereof.

In certain embodiments of the present invention, the crosslinking agent may be formulated to remain inactive until it is "activated" by, for example, certain conditions in the fluid (e.g., pH, temperature, etc.) and/or interaction with some other substance. In some embodiments, the activation of the crosslinking agent may be delayed by encapsulation with a coating (e.g., a porous coating through which the crosslinking agent may diffuse slowly, or a degradable coating that degrades downhole) that delays the release of the crosslinking agent until a desired time or place. The choice of a particular crosslinking agent will be governed by several considerations that will be recognized by one skilled in the art, including, but not limited to, the type of gelling agent(s) used, the molecular weight of the gelling agent(s) used, the conditions in the subterranean formation being treated, the safety handling requirements, the pH of the fluid, temperature, and/or the desired delay for the crosslinking agent to crosslink the gelling agent molecules to form the water-soluble viscosifying agents of the present invention.

In those embodiments in which a crosslinked gelling agent is used as the water-soluble viscosifying compound of the present invention, the crosslinking agent may be present in the fluids of the present invention in an amount sufficient to provide the desired degree of crosslinking between molecules of the gelling agent. In certain embodiments, the crosslinking agent may be present in an amount in the range of from about 0.01% to about 5% by weight of the gelling agent. In preferred embodiments, the crosslinking agent may be present in the fluids of the present invention in an amount in the range of from about 0.1% to about 2% by weight of the gelling agent.

In some embodiments, a foaming agent may be suitable for use in the present invention as a water-soluble viscosifying agent. As used herein, the term "foam" refers to a two-phase composition having a continuous liquid phase and a discontinuous gas phase. The foaming agents for use as the water-soluble viscosifying compounds in the present invention comprise a gas and a foaming compound. Suitable gases include, but are not limited to, nitrogen; carbon dioxide; air; methane; helium; argon; and any combination thereof. One skilled in the art, with the benefit of this disclosure, should understand the benefit of each gas. By way of nonlimiting example, carbon dioxide foams may have deeper well capability than nitrogen foams because carbon dioxide foams have greater density than nitrogen foams so that the surface pumping pressure required to reach a corresponding depth is lower with carbon dioxide than with nitrogen. Moreover, the higher density may impart greater proppant transport capability, up to about 12 lb of proppant per gal of fracture fluid.

Suitable foaming compounds for use in conjunction with the present invention may include, but are not limited to, cationic foaming compounds; anionic foaming compounds; amphoteric foaming compounds; nonionic foaming compounds; and any combination thereof. Nonlimiting examples of suitable foaming compounds may include, but are not limited to, a betaine; a sulfated alkoxylate; a sulfonated alkoxylate; an alkyl quaternary amine; an alkoxylated linear alcohol; an alkyl sulfonate; an alkyl aryl sulfonate; a C10-C20 alkyldiphenyl ether sulfonatel; a polyethylene glycol; an ether of alkylated phenol; sodium dodecylsulfate; alpha olefin sulfonate (e.g., sodium dodecane sulfonate); trimethyl hexadecyl ammonium bromide; any derivative thereof; and any combination thereof. The foaming compounds may be included in fluids useful in the methods of the present invention at concentrations ranging typically from about 0.05% to about 2% of the liquid component by weight (e.g., from about 0.5 to about 20 gallons per 1000 gallons of liquid).

In some embodiments, the quality of the foamed fluids of the present invention (e.g., pad fluid, fracturing fluid, gravel packing fluid, frac-packing fluid) when a foaming agent is included as a water-soluble viscosifying compound may range from a lower limit of about 5%, 10%, 25%, 40%, 50%, 60%, or 70% gas volume to an upper limit of about 95%, 90%, 80%, 75%, 60%, or 50% gas volume, and wherein the quality of the foamed fluid may range from any lower limit to any upper limit and encompass any subset therebetween. Most preferably, the foamed fluid may have a foam quality from about 85% to about 95%, or about 90% to about 95%.

In some embodiments, the pad fluid, fracturing fluid, gravel packing fluid, and/or frac-packing fluid of the present invention may further comprise a degradable fluid loss control agent. As used herein, the term "fluid loss" refers to the undesirable migration or loss of fluids into a subterranean formation, gravel-pack, or proppant pack. Fluid loss may be problematic in each of fracturing, gravel packing, and frac-packing operations, resulting, for example, in a reduction in fluid efficiency. Degradable fluid loss control agents are additives that lower the volume of a filtrate that passes through a filter medium and that degrade over time in the subterranean formation. That is, they block the pore throats and spaces that otherwise allow a fluid to leak out of a desired zone and into an undesirable zone. Suitable degradable fluid loss control additives for use in the various fluids of the present invention may include, but are not limited to, a polysaccharide; a chitin; a chitosan; a protein; an aliphatic polyester; a poly(lactide); a poly(glycolide); a poly(ϵ-caprolactone); a poly(hydrooxybutyrate); a poly(anhydride); an aliphatic polycarbonate; a poly(orthoester); a poly(amino acid); a poly(ethylene oxide); a polyphosphazene; and any combination thereof. An example of a suitable commercially available fluid loss control agent for use in the fluids of the present invention is IN-DRIL® HT Plus, available from Halliburton Energy Services, Inc. in Houston, Tex. In some embodiments, where it is included, the fluid loss control agent may be present in an amount ranging from about 0.1% to about 10% by weight of the liquid component of the fluids of the present invention.

In those embodiments of the present invention where a water-soluble viscosifying compound is used in the pad fluid, fracturing fluid, gravel packing fluid, and/or frac-packing fluid of the present invention may further comprise a breaker. A breaker may cause the viscosified fluids of the present invention to revert to a thin fluid that can be circulated easily back to the surface of the wellbore. In some embodiments, the breaker may be formulated to remain inactive until it is "activated" by, for example, certain conditions in the fluids of the present invention (e.g., pH, temperature, salinity, and the like) and/or interaction with some other substance. In some embodiments, the breaker may be delayed by encapsulation with a coating (e.g., a porous coating through which the breaker may diffuse slowly, or a degradable coating that degrades downhole) that delays the release of the breaker. In other embodiments, the breaker itself may be a degradable material (e.g., polylactic acid or polyglycolic acid) that releases an acid or alcohol in the presence of the aqueous base fluids of the present invention. Suitable breakers include, but are not limited to, a sodium chlorite; a hydrochlorite; a perborate; a persulfate; a peroxide (e.g., an organic peroxide, a tert-butyl hydroperoxide, or a tertamyl hydroperoxide); an acid; a polysaccharide; and any combination thereof. If a breaker is used in the fluids of the present invention, it may be present in an amount in the range from about 0.1 to about 10 gallons in 1000 gallons of the fluid.

In some embodiments, the pad fluid, fracturing fluid, gravel packing fluid, and/or frac-packing fluid of the present invention may comprise a weighting agent. Weighting agents are used to, for example, increase the fluid density and thereby affect the hydrostatic pressure exerted by the fluid. Suitable weighting agents for use in the fluids of the present invention include, but are not limited to, potassium chloride; sodium chloride; sodium bromide; calcium chloride; calcium bromide; ammonium chloride; zinc bromide; zinc formate; zinc oxide; barium sulfate; lead(II) sulfide; and any combination thereof. The weighting agent may be present in the fluids of the present invention in any amount sufficient to achieve the desired fluid density and hydrostatic pressure. In some embodiments, the weighting agent may be present in an amount ranging from about 0.1% to about 20% by weight of the liquid component of the fluids of the present invention. In other embodiments, the weighting agent may be present in an amount ranging from about 1% to about 10% by weight of the liquid component of the fluids of the present invention.

In some embodiments of the present invention, the nanoparticulates are coated or impregnated with a delayed tackifying agent. The nanoparticulates may be coated or impregnated with the delayed tackifying agents either prior to introducing the nanoparticulates into the wellbore in the subterranean formation or "on-the-fly" at the wellbore. As used herein, the term "on-the-fly" refers to performing an operation during a subterranean treatment that does not require stopping normal operations. Coating or impregnating the nanoparticulates with the delayed tackifying agent of the present invention may enhance grain-to-grain or grain-to-formation adherence between the individual nanoparticulates and/or the loose particles from the subterranean formation. That is, the delayed tackifying agent is capable of becoming tacky such that it acts to stabilize particulates downhole. As used herein, the term "tacky," in all its forms, generally refers to a substance having a nature such that it is (or may be activated to become) somewhat sticky to the touch. As used herein, the term "impregnated" refers to filling, saturating, or permeating a substance into a nanoparticulate. The nanoparticulates of the present invention may be impregnated, for example, when the shape of the nanoparticulate is particularly porous or has areas of void space, such as when a self-assembled network of nanoparticulates is to be treated with the delayed tackifying agent. In some embodiments, the nanoparticulates may be only partially coated or impregnated with the delayed tackifying agent. For example, a dendritic-shaped nanoparticulate may preferably be coated with the delayed tackifying agent only on its dendritic projections, which may allow more flexibility to a network of grain-to-grain contacted nanoparticulates.

The delayed tackifying agent may be "activated" by certain conditions within the subterranean formation or within the pad fluid in which the nanoparticulates are suspended, such as, for example, temperature, time, pressure, pH, salinity, and the like. The delayed tackifying agents can thus be generally inert until they reach a target interval, where they will become activated to exhibit the desired tackiness to aid in controlling weakly consolidated intervals in a subterranean formation.

Suitable delayed tackifying agents for use in the present invention include, but are not limited to, a polymerizable monomer; a polymerizable oligomer; a two-component resin agent; and any combination thereof. Typically, the polymerizable monomers for use as delayed tackifying agents of the present invention contain at least one functional group including, but not limited to, a urethane; an amine; an acrylic; a carboxylic; an amide; a hydroxyl; and any combination thereof. Suitable polymerizable monomers may include, but are not limited to, monofunctional acrylates, multifunctional acrylates, monofunctional methacrylates, or multifunctional methacrylates. The polymerizable oligomers suitable for use as a delayed tackifying agent of the present invention may include, but are not limited to, an aromatic urethane acrylate; an aliphatic urethane acrylate; an epoxy acrylate; a urethane acrylate; a urethane dimethacrylate; and any combination thereof. The two-component resin agents for use in the methods of the present invention comprise a liquid hardenable resin component and a liquid hardening component. Optionally, a silane coupling agent and a surfactant may be included in the two-component resin agent so as to facilitate handling, mixing, and coating or impregnating of the resin agent onto the nanoparticulates. In some embodiments, the delayed tackifying agent of the present invention is present in the range of about 0.1% to 20% by weight of the nanoparticulates. In other embodiments, the delayed tackifying agent of the present invention is present in the range of about 1% to about 3% by weight of the nanoparticulates.

Suitable liquid hardenable resins for use in the two-component resin agent of the present invention may include, but are not limited to, a bisphenol A-epichlorohydrin resin; a novolak resin; a polyepoxide resin; a phenol-aldehyde resin; a urea-aldehyde resin; a urethane resin; a phenolic resin; a furan resin; a furan/furfuryl alcohol resin; a phenolic/latex resin; a phenol formaldehyde resin; a polyester resin; a polyurethane resin; an acrylate resin; a silicon-based resin; a glycidyl ether resin; a bisphenol A-diglycidyl ether resin; a butoxymethyl butyl glycidyl ether resin; a bisphenol F resin; an epoxide resin; any hybrids thereof; any copolymers thereof; and any combination thereof. Some suitable liquid hardenable resins, such as epoxy resins, may be cured with an internal catalyst or activator so that when pumped down hole, they may be cured using only time and temperature. Other suitable resins, such as furan resins generally require a time-delayed catalyst or an external catalyst to help activate the polymerization of the resins if the cure temperature is low (i.e., less than 250° F.), but will cure under the effect of time and temperature if the formation temperature is above about 250° F., preferably above about 300° F. It is within the ability of one skilled in the art, with the benefit of this disclosure, to select a suitable liquid hardenable resin for use in the two-component resin agents of the present invention to achieve the desired delayed activity. Generally, the liquid hardenable resin component of the two-component resin agent is present in an amount in the range from about 5% to about 95% by weight of the liquid hardening component. It is within the ability of one skilled in the art, with the benefit of this disclosure, to determine how much of the liquid hardenable resin component may be needed to achieve the desired results based on, for example, the type of the liquid hardenable resin component used, the type of liquid hardening component used, the conditions of the subterranean formation, the type and size of nanoparticulates used, and the like.

The liquid hardening component of the two-component resin agent of the present invention may include, but is not limited to, a cyclo-aliphatic amine; a piperazine, an aminoethylpiperazine; an aromatic amine; a methylene dianiline; a 4,4'-diaminodiphenyl sulfone; an aliphatic amine; an ethylene diamine; a diethylene triamine; a triethylene tetraamine; a triethylamine; a benzyldiethylamine; a N,N-dimethylaminopyridine; 2-(N.sub.2N-dimethylaminomethyl)phenol; tris(dimethylaminomethyl)phenol; a tetraethylene pentaamine; an imidazole; a pyrazole; a pyrazine; a pyrimidine; a pyridazine; 1H-indazole; a purine; a phthalazine; a naphthyridine; a quinoxaline; a quinazoline; a phenazine; an imidazolidine; a cinnoline; an imidazoline; 1,3,5-triazine; a thiazole; a pteridine; an indazole; an amine; a polyamine; an amide; a polyamide; 2-ethyl-4-methyl imidazole; any derivative thereof; and any combination thereof. The liquid hardening component of the two-component resin agents of the present invention may be included in an amount sufficient to at least partially harden the liquid hardenable resin component. In some embodiments of the present invention, the liquid hardening component may be present in an amount in the range of about 0.1% to about 95% by weight of the liquid hardenable resin component. In other embodiments, the liquid hardening component may be present in an amount in the range of about 15% to about 85% by weight of the liquid hardenable resin component. In other embodiments, the liquid hardening component may be present in the range of about 15% to about 55% by weight of the liquid hardenable resin component.

Optionally, in some embodiments of the present invention where a two-component resin agent is used as the delayed tackifying agent of the present invention, a silane coupling agent and/or a surfactant is included to facilitate the coating and bonding of the two-component resin agent onto or with (e.g., impregnation) the nanoparticulates of the present invention. Examples of suitable silane coupling agents include, but are not limited to, N-2-(aminoethyl)-3-aminopropyltrimethoxysilane; 3-glycidoxypropyltrimethoxysilane; and any combination thereof. The silane coupling agent may be included in the liquid hardenable resin component or the liquid hardening component (according to the chemistry of the particular group as determined by one skilled in the art with the benefit of this disclosure). In some embodiments of the present invention, the silane coupling agent used is included in the liquid hardenable resin component in the range of about 0.1% to about 3% by weight of the liquid hardening component.

Any surfactant compatible with the liquid hardening component and capable of facilitating the coating of the liquid hardenable resin onto the nanoparticulates of the present invention may be used in the liquid hardenable resin component. Such surfactants include, but are not limited to, an alkyl phosphonate surfactant (e.g., a C12-C22 alkyl phosphonate surfactant); an ethoxylated nonyl phenol phosphate ester; one or more cationic surfactants; one or more nonionic surfactants; and any combination thereof. Examples of such surfactant combinations are described in U.S. Pat. No. 6,311,773, the entire disclosure of which is incorporated herein by reference. The surfactant or surfactants that may be used in the methods of the present invention may be present in the liquid hardenable resin component in an amount in the range of about 1% to about 10% by weight of the liquid hardening component.

Thus, some embodiments of the present invention provide:

(A) Methods of fracturing a weakly consolidated target interval in a wellbore in a subterranean formation comprising providing a pad fluid comprising an aqueous base fluid and nanoparticulates, and a fracturing fluid comprising an aqueous base fluid and gravel. The pad fluid is introduced into the wellbore in the subterranean formation at or above a fracture gradient rate so as to create or enhance at least one fracture at or near the weakly consolidated target interval in the subterranean formation. This allows the nanoparticulates in the pad fluid penetrate into the weakly consolidated target interval and into the fracture. Then the fracturing fluid is introduced into the wellbore in the subterranean formation at or above the fracture gradient rate so as to enhance the fracture and form a proppant pack in the at least one fracture. Finally, the weakly consolidated target interval is consolidated via placement of the nanoparticulates penetrated into the weakly consolidated target interval.

(B) Methods of gravel packing a weakly consolidated target interval in a wellbore in a subterranean formation comprising providing a pad fluid comprising an aqueous base fluid and nanoparticulates, and a gravel packing fluid comprising an aqueous base fluid and gravel. A permeable screen is positioned within the wellbore in the subterranean formation adjacent to the weakly consolidated target interval to form an annulus between the permeable screen and the wellbore in the subterranean formation. One the screen is placed, the pad fluid is introduced in the annulus between the permeable screen and the wellbore in the subterranean formation at a matrix flow rate, such that the nanoparticulates in the pad fluid penetrate into the weakly consolidated target interval. Next, a gravel packing fluid is placed in the annulus between the permeable screen and the wellbore in the subterranean formation at a matrix flow rate so as to form a permeable gravel pack adjacent to the weakly consolidated target interval. Finally, the weakly consolidated target interval is consolidated via placement of the nanoparticulates penetrated into the weakly consolidated target interval.

(C) Methods of frac-packing a weakly consolidated target interval in a wellbore in a subterranean formation comprising providing a pad fluid comprising an aqueous base fluid and nanoparticulates, and a frac-packing fluid comprising an aqueous base fluid and gravel. A permeable screen is positioned within the wellbore in the subterranean formation adjacent to the weakly consolidated target interval to form an annulus between the permeable screen and the wellbore in the subterranean formation. One the screen is placed, the pad fluid is introduced into the annulus between the permeable screen and the wellbore in the subterranean formation at or above a fracture gradient rate to create or enhance at least one fracture at or near the weakly consolidated target interval, such that the nanoparticulates in the pad fluid penetrate into the weakly consolidated target interval. Next, the frac-packing fluid is introduced into the annulus between the permeable screen and the wellbore in the subterranean formation at or above the fracture gradient rate so as to enhance the at least one fracture, form a proppant pack in the at least one fracture, and form a permeable gravel pack adjacent in the annulus adjacent to the weakly consolidated target interval. Finally, the weakly consolidated target interval is consolidated via placement of the nanoparticulates penetrated into the weakly consolidated target interval.

Each of embodiments A, B, and C (above) may have one or more of the following additional elements in any combination (that is, A may be combined with elements 1, 2, and 5 or may be combined with 2, 3, and 6, or only with 2, etc.):

Element 1: A method wherein a prepad fluid comprising an aqueous base fluid and nanoparticulates is introduced into the wellbore in the subterranean formation at a matrix flow rate, such that the nanoparticulates in the prepad fluid penetrate into the weakly consolidated target interval prior to the step of introducing the pad fluid in the wellbore in the subterranean formation Element 2: A method wherein one or more of the pad fluid, the fracturing fluid, the gravel packing fluid, or the frac-pack fluid further comprises at least one selected from the group consisting of a water-soluble viscosifying compound; a breaker; a degradable fluid loss control agent; and a weighting agent.

Element 3: A method wherein the nanoparticulates are formed from a material selected from the group consisting of a silk; a cellulose; a starch; a polyamid; silica; alumina; zirconia; a polyurethane; a polyester; a polyolefin; collagen; a polyglycolic; an alkaline earth metal oxide; an alkaline earth metal hydroxide; an alkali metal oxide; an alkali metal hydroxide; a transition metal oxide; a transition metal hydroxide; a post-transition metal oxide; a post-transition metal hydroxide; a piezoelectric crystal; a pyroelectric crystal; and any combination thereof.

Element 4: A method wherein the nanoparticulates have a shape selected from the group consisting of sphere-shaped; rod-shaped; fiber-shaped; cup-shaped; cube-shaped; truncated cube-shaped; rhombic dodecahedron-shaped; truncated rhombic-dodecahedron-shaped; oval-shaped; diamond-shaped; pyramid-shaped; polygon-shaped; torus-shaped; dendritic-shaped; astral-shaped; cylinder-shaped; irregular-shaped; triangular-shaped; bipyramid-shaped; tripod-shaped; wire-shaped; tetrahedron-shaped; cuboctahedron-shaped; octahedron-shaped; truncated octahedron-shaped; icosahedron-shaped; and any combination thereof.

Element 5: A method wherein the nanoparticulates are fiber-shaped and have a diameter in the range of about 10 to about 100 nm, and a length in the range of about 50 to 800 nm Element 6: A method wherein the nanoparticulates have a mesh size in the range from about 1 to about 200 nanometers.

Element 7: A method wherein the nanoparticulates are partially or fully coated or impregnated with a delayed tackifying agent.

Element 8: A method wherein the nanoparticulates are partially or fully impregnated with at least one ion selected from the group consisting of a monoatomic cation; a monoatomic anion; a polyatomic cation; a polyatomic anion; and any combination thereof.

Element 9: A method wherein the nanoparticulates penetrate into the weakly consolidated target interval or into the at least one fracture in the range between about 1 to about 6 wellbore diameters.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present invention. The invention illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

The invention claimed is:

1. A method comprising:

providing a pad fluid comprising an aqueous base fluid and nanoparticulates, wherein the nanoparticulates are impregnated with an ion that is filled, saturated, or permeated into the nanoparticulates, the ion selected from the group consisting of a monoatomic cation; a monoatomic anion; a polyatomic cation; a polyatomic anion; and any combination thereof and the ion present in an amount of about 0.1% to about 20% by weight of the nanoparticulates, wherein the ion is selected to aggregate the nanoparticulates to form a network, and wherein the wellbore has a diameter, and the nanooarticulates penetrate into the vugular weakly consolidated target interval or into the at least one fracture equivalent to a distance in the range between about 1 to about 6 wellbore diameters;

providing a fracturing fluid comprising an aqueous base fluid and gravel;

first, introducing the pad fluid in a wellbore in the subterranean formation at or above a fracture gradient rate so as to create or enhance at least one fracture at or near a vugular weakly consolidated target interval in the subterranean formation, such that the nanoparticulates in the pad fluid penetrate into the weakly consolidated target interval and into the at least one fracture;

then, after introducing the pad fluid, introducing the fracturing fluid in the wellbore in the subterranean formation at or above the fracture gradient rate so as to enhance the at least one fracture and form a proppant pack in the at least one fracture; and consolidating the weakly consolidated target interval due to the placement of the nanoparticulates penetrated into the weakly consolidated target interval.

2. The method of claim 1, wherein a prepad fluid comprising an aqueous base fluid and nanoparticulates is introduced into the wellbore in the subterranean formation at a matrix flow rate, such that the nanoparticulates in the prepad fluid penetrate into the vugular weakly consolidated target interval prior to the step of introducing the pad fluid in the wellbore in the subterranean formation.

3. The method of claim 1, wherein the pad fluid or the fracturing fluid further comprises at least one selected from the group consisting of a water-soluble viscosifying compound; a breaker; a degradable fluid loss control agent; a weighting agent; and any combination thereof.

4. The method of claim 1, wherein the nanoparticulates are formed from a material selected from the group consisting of a silk; a cellulose; a starch; a polyamid; carbon silica; alumina; zirconia; a polyurethane; a polyester; a polyolefin; collagen; a polyglycolic; an alkaline earth metal oxide; an alkaline earth metal hydroxide; an alkali metal oxide; an alkali metal hydroxide; a transition metal oxide; a transition metal hydroxide; a post-transition metal oxide; a post-transition metal hydroxide; a piezoelectric crystal; a pyroelectric crystal; and any combination thereof.

5. The method of claim 1, wherein the nanoparticulates have a shape selected from the group consisting of sphere-shaped; rod-shaped; fiber-shaped; cup-shaped; cube-shaped; truncated cube-shaped; rhombic dodecahedron-shaped; truncated rhombic-dodecahedron-shaped; oval-shaped; diamond-shaped; pyramid-shaped; polygon-shaped; torus-shaped; dendritic-shaped; astral-shaped; cylinder-shaped; irregular-shaped; triangular-shaped; bipyramid-shaped; tripod-shaped; wire-shaped; tetrahedron-shaped; cuboctahedron-shaped; octahedron-shaped; truncated octahedron-shaped; icosahedron-shaped; and any combination thereof.

6. The method of claim 1, wherein the nanoparticulates are fiber-shaped and have a diameter in the range of about 10 to about 100 nm, and a length in the range of about 50 to 800 nm.

7. The method of claim 1, wherein the nanoparticulates have a mesh size in the range from about 1 to about 200 nanometers.

8. The method of claim 1, wherein the nanoparticulates are partially or fully coated or impregnated with a delayed tackifying agent.

9. The method of claim 1, wherein the ion is selected from the group consisting of a monoatomic anion; a polyatomic anion; and any combination thereof.

10. A method of gravel packing comprising:

positioning a permeable screen within a wellbore in the subterranean formation adjacent to a vugular weakly consolidated target interval to form an annulus between the permeable screen and the wellbore in the subterranean formation;

providing a pad fluid comprising an aqueous base fluid and nanoparticulates, wherein the nanoparticulates are impregnated with an ion that is filled, saturated, or permeated into the nanoparticulates, the ion selected from the group consisting of a monoatomic cation; a monoatomic anion; a polyatomic cation; a polyatomic anion; and any combination thereof and the ion present in an amount of about 0.1% to about 20% by weight of the nanoparticulates, wherein the ion is selected to aggregate the nanoparticulates to form a network, and wherein the wellbore has a diameter, and the nanoparticulates penetrate into the vugular weakly consolidated target interval or into the at least one fracture equivalent to a distance in the range between about 1 to about 6 wellbore diameters;

providing a gravel packing fluid comprising an aqueous base fluid and gravel;

first, introducing the pad fluid in the annulus between the permeable screen and the wellbore in the subterranean formation at a matrix flow rate, such that the nanoparticulates in the pad fluid penetrate into the vugular weakly consolidated target interval;

then, after introducing the pad fluid, introducing the gravel packing fluid in the annulus between the permeable screen and the wellbore in the subterranean formation at a matrix flow rate so as to form a permeable gravel pack adjacent to the vugular weakly consolidated target interval; and consolidating the vugular weakly consolidated target interval due to the placement of the nanoparticulates penetrated into the vugular weakly consolidated target interval and the permeable gravel pack adjacent to the vugular weakly consolidated target interval.

11. The method of claim 10, wherein the nanoparticulates are formed from a material selected from the group consisting of a silk; a cellulose; a starch; a polyamid; carbon silica; alumina; zirconia; a polyurethane; a polyester; a polyolefin; collagen; a polyglycolic; an alkaline earth metal oxide; an alkaline earth metal hydroxide; an alkali metal oxide; an alkali metal hydroxide; a transition metal oxide; a transition metal hydroxide; a post-transition metal oxide; a post-transition metal hydroxide; a piezoelectric crystal; a pyroelectric crystal; and any combination thereof.

12. The method of claim 10, wherein the nanoparticulates have a shape selected from the group consisting of sphere-shaped; rod-shaped; fiber-shaped; cup-shaped; cube-shaped; truncated cube-shaped; rhombic dodecahedron-shaped; truncated rhombic-dodecahedron-shaped; oval-shaped; diamond-shaped; pyramid-shaped; polygon-shaped; torus-shaped; dendritic-shaped; astral-shaped; cylinder-shaped; irregular-shaped; triangular-shaped; bipyramid-shaped; tripod-shaped; wire-shaped; tetrahedron-shaped; cuboctahedron-shaped; octahedron-shaped; truncated octahedron-shaped; icosahedron-shaped; and any combination thereof.

13. The method of claim 10, wherein the nanoparticulates have a mesh size in the range from about 1 to about 200 nanometers.

14. The method of claim 10, wherein the nanoparticulates are partially or fully coated or impregnated with a delayed tackifying agent.

15. The method of claim 10, wherein the ion is selected from the group consisting of a monoatomic anion; a polyatomic anion; and any combination thereof.

16. A method of frac-packing comprising:

positioning a permeable screen within a wellbore in the subterranean formation adjacent to a vugular weakly consolidated target interval to form an annulus between the permeable screen and the wellbore in the subterranean formation;

providing a pad fluid comprising an aqueous base fluid and nanoparticulates, wherein the nanoparticulates are impregnated with an ion that is filled, saturated, or permeated into the nanoparticulates, the ion selected from the group consisting of a monoatomic cation; a monoatomic anion; a polyatomic cation; a polyatomic anion; and any combination thereof and the ion present in an amount of about 0.1% to about 20% by weight of the nanoparticulates, wherein the ion is selected to aggregate the nanoparticulates to form a network, and wherein the wellbore has a diameter, and the nanooarticulates penetrate into the vugular weakly consolidated target interval or into the at least one fracture equivalent to a distance in the range between about 1 to about 6 wellbore diameters;

providing a frac-packing fluid comprising an aqueous base fluid and gravel;

first, introducing the pad fluid in the annulus between the permeable screen and the wellbore in the subterranean formation at or above a fracture gradient rate so as to create or enhance at least one fracture at or near the vugular weakly consolidated target interval in the wellbore in the subterranean formation, such that the nanoparticulates in the pad fluid penetrate into the vugular weakly consolidated target interval;

then, after introducing the pad fluid, introducing the frac-packing fluid in the annulus between the permeable screen and the wellbore in the subterranean formation at or above the fracture gradient rate so as to enhance the at least one fracture, form a proppant pack in the at least one fracture, and form a permeable gravel pack adjacent to the vugular weakly consolidated target interval; and consolidating the vugular weakly consolidated target interval due to the placement of the nanoparticulates penetrated into the vugular weakly consolidated target interval.

17. The method of claim 16, wherein the nanoparticulates are formed from a material selected from the group consisting of a silk; a cellulose; a starch; a polyamid; carbon silica; alumina; zirconia; a polyurethane; a polyester; a polyolefin; collagen; a polyglycolic; an alkaline earth metal oxide; an alkaline earth metal hydroxide; an alkali metal oxide; an alkali metal hydroxide; a transition metal oxide; a transition metal hydroxide; a post-transition metal oxide; a post-transition metal hydroxide; a piezoelectric crystal; a pyroelectric crystal; and any combination thereof.

* * * * *